United States Patent [19]

Aoki et al.

[11] 3,995,423

[45] Dec. 7, 1976

[54] SAFETY DEVICE FOR USE IN AN APPARATUS FOR CLEANSING THE EXHAUST GAS IN AN INTERNAL COMBUSTION ENGINE

[75] Inventors: Keiji Aoki; Kenji Goto, both of Susono, Japan

[73] Assignee: Toyota Jidosha Kogyo Kabushiki Kaisha, Toyota, Japan

[22] Filed: Feb. 6, 1976

[21] Appl. No.: 655,778

Related U.S. Application Data

[63] Continuation of Ser. No. 509,913, Sept. 27, 1974, abandoned.

[30] Foreign Application Priority Data

July 26, 1974 Japan ..... 49-85062

[52] U.S. Cl. ..... 60/288; 23/288 FA

[51] Int. Cl.[2] ..... F01N 3/15

[58] Field of Search ..... 60/288; 23/288 FA; 137/805, 829, 832

[56] References Cited

UNITED STATES PATENTS

| | | | |
|---|---|---|---|
| 3,144,309 | 8/1964 | Sparrow | 60/288 |
| 3,159,208 | 12/1964 | Joesting | 137/805 |
| 3,313,313 | 4/1967 | Katz | 137/832 |
| 3,783,619 | 1/1974 | Alquist | 60/288 |

FOREIGN PATENTS OR APPLICATIONS

| | | | |
|---|---|---|---|
| 1,948,777 | 4/1970 | Germany | 60/288 |

*Primary Examiner*—Douglas Hart
*Attorney, Agent, or Firm*—Stevens, Davis, Miller & Mosher

[57] ABSTRACT

A safety device to be used in an apparatus for cleansing the exhaust gas in an internal combustion engine, comprising an OR-NOR fluidic amplifier, an inlet port of which is connected to the downstream of an exhaust manifold and one of outlet ports of which is connected to the upstream of the cleansing apparatus, the other outlet port being connected to the upstream of a by-pass which diverts from the downstream end of the exhaust manifold to form a passage differing from that of the cleansing apparatus, the by-pass being provided with two-way valve means therein by which the by-pass may be opened or closed.

3 Claims, 3 Drawing Figures

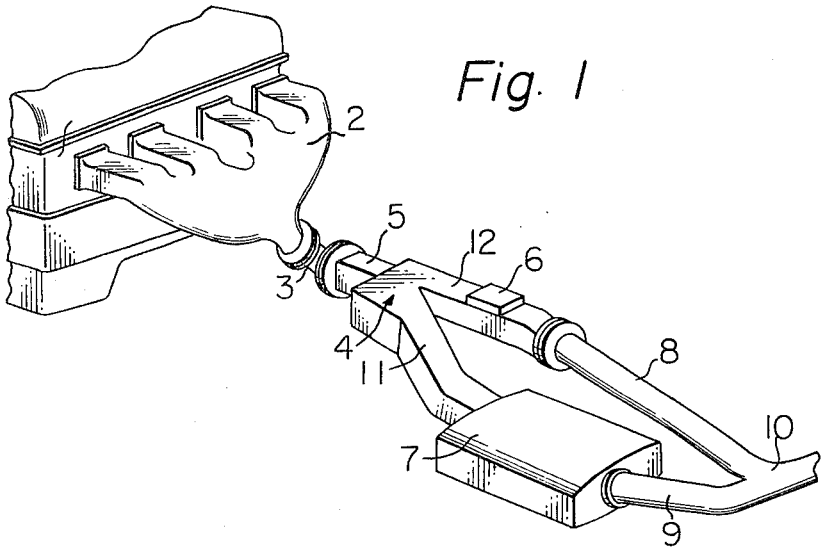
Fig. 1
Fig. 2A
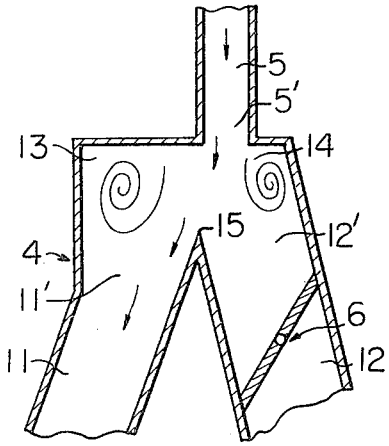
Fig. 2B
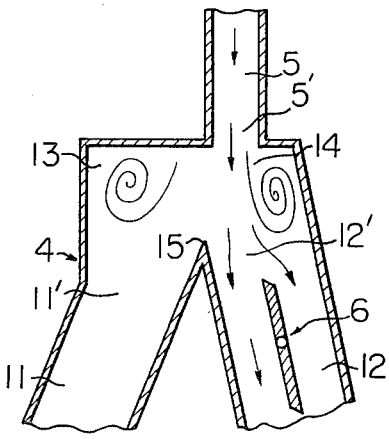

SAFETY DEVICE FOR USE IN AN APPARATUS FOR CLEANSING THE EXHAUST GAS IN AN INTERNAL COMBUSTION ENGINE

This is a continuation of application Ser. No. 509,913 filed Sept. 27, 1974, now abandoned.

This invention relates generally to a safety device for a cleansing apparatus for the exhaust gas in an internal combustion engine, and more particularly, to a device for preventing over-heating in the catalytic converter provided in the exhaust system.

Catalytic converters are used to exclude noxious components, such as HC, CO and NOx from the exhaust gas discharged by internal combustion engines, in particular automobile engines, or to diminish the amount thereof. In such converters, scorching of the mat spread on the vehicle floor, or fire within the body of the vehicle can be prevented by the exhaust gas temporarily by-passing the converter when the floor of the catalyzer has become extremely hot due to either prolonged usage of the engine, or its usage at high speeds, or with heavy loads. This by-passing method is also essential in view of prolonging the service life of the converter. In known apparatuses, diversion of the flow route of the exhaust gas has been performed by a poppet type three-way valve arranged in the section in which the by-pass is diverted from a passage leading to the catalytic converter, or in the junction of the by-pass and said passage. In these known apparatuses, no exhaust gas is required to flow into the closed flow route and in particular, when the route comprising the converter is closed, it is absolutely necessary that there be not the slightest amount of exhaust gas flowing into the converter. For this purpose, a sealing between the valve and the valve seat must be completely effected. To this end, it is necessary that a load exerted upon the valve seat by the valve should be increased. Further, in the conventional three-way valve, as there is at least one valve seat in each passage, meaning that there are at least two valve seats on the whole, said seal must be provided in at least two positions. The operating force of the valve will, consequently, increase. Generally, the valve is operated by a pressure and diaphragm means and, therefore, thermostability must be provided to the diaphragm means. This will make the construction of the apparatuses more complex and raise the cost of manufacture thereof. Furthermore, the valve and valve stem, subjected to the heat of the exhaust gas are inclined to be subjected to some degree of straining.

The main object of the present invention is to provide a safety device for a cleansing apparatus for the exhaust gas in an internal combustion engine, which can eliminate the above mentioned disadvantages while having a simple construction and excellent sealing efficacy.

Other features, additional objects, and many of the attendant advantages of this invention may readily be appreciated with reference to the following detailed description of the preferred embodiment, to be considered with the appended drawings in which:

FIG. 1 shows a perspective view of the safety device for the catalytic converter according to the present invention, and, FIGS. 2A and 2B show schematic views of the flow routes of the exhaust gas in two different positions of the valve.

Referring to FIG. 1, an exhaust manifold 2 attached to a cylinder head 1 joins an exhaust pipe 3. A safety device 4 according to the present invention is connected to the exhaust pipe 3. The safety device 4 is essentially in the form of a "OR-NOR fluidic amplifier (device)" as shown in FIGS. 2A and 2B and comprises an inlet port 5' and outlet ports 11' and 12'. The three ports 5', 11' and 12' form a part of an injection passage 5, a branch 11 leading to a catalytic converter 7 and a by-pass 12, respectively. A downstream passage 9 of the converter 7 and a downstream passage 8 of the by-pass 12 join an exhaust pipe 10 opening to the atmosphere. Thus, two flow routes for the exhaust gas are formed, one, comprising injection passage 5 → branch → catalytic converter 7, → passage 9 and exhaust pipe 10, and the other, comprising injection passage 5, → by-pass 12, → passage 8 → and exhaust pipe 10. The exhaust gas (shown by arrows in the drawings) flows into the converter 7 to be cleaned therein. The inlet port 5, and outlet ports 11 and 12 are, preferably, formed with rectangular sections, so as to render the so-called "Coanda effect" more effective, as will be explained below in further detail. Valve means 6, consisting of a two-way valve, is provided in the by-pass 12 as is also shown in FIGS. 2A and 2B. Valve means 6 itself is essentially a conventional two-way valve operated by, for example, a diaphragm means and, therefore, no detailed explanation will be effected hereinafer.

Safety device 4 is formed with a fluidic amplifier, comprising two vortex chambers 13 and 14 which have different effective volumes. The numeral 15 shows a splitter for separating the outlet flow, that is, for preventing the exhaust gas which flows into one outlet port from escaping into the other outlet port.

When fluid comes into a passage from a narrower passage, vortexes occur along the side wall of the former passage and the fluid is forced toward the stronger vortex. This phenomenon is well known as the "Coanda effect".

The safety device according to the present invention operates as follows.

In the normal condition of catalytic converter 7, valve means 6 occupies a position shown in FIG. 2A to close by-pass 12. The exhaust gas from the exhaust manifold 2 flows into the exhaust pipe 3 and is injected into the safety device, i.e. the fluidic amplifier through the inlet port 5'. The exhaust gas then flows, into the branch, i.e. the outlet port 11' communicating with the catalytic converter 7 and producing vortexes in the vortex chambers 13 and 14 by the above mentioned "Coanda effect". Owing to the "suction" effect of the vortex flow in the vortex chamber 14, the pressure in the vortex chamber 14 and in the upstream side of valve means 6 in by-pass 12 is lower than that in the upstream side of catalytic converter 7. Now consider a conventional symmetrical shaped branch pipe in which the effective volumes of both vortex chambers are equal. It will be easily understood that the pressure difference between the upstream side and downstream side of the valve means 6 is equal to a pressure loss in the catalytic converter 7 and the branch 9, and, therefore, the pressure of the upstream side of the valve means 6 is equal to the pressure of the inlet side of the converter 7. In other words, by utilizing a fluidic amplifier with two vortex chambers having different effective volumes, the amount of leakage of the exhaust gas in valve means 6 in comparison with that in a conventional two-way valve, is considerably reduced owing to the before-mentioned "suction" effect.

When the catalytic converter is dangerously overheated because of the before mentioned reasons, valve means 6 is manually or automatically moved to an open positon shown in FIG. 2B. Also in the case, vortexes occur in vortex chambers 13 and 14 due to the "Coanda effect". However, it is known the vortex flow in vortex chamber 14 is stronger than that in vortex chamber 13, as the effective volume of chamber 14 is smaller than that of chamber 13. As a result, the exhaust gas is attracted to the upstream side wall of by-pass 12, i.e. outlet port 12', and subsequently is forced to flow into by-pass 12 and branch 8. Thus, a change of flow route is performed, and no exhaust gas flows into the converter 7.

The safety device according to the present invention makes it possible to feed the exhaust gas into either the converter or the by-pass and to provide a three-way valve with an equivalent function by using a two-way valve means, as well as a fluidic amplifier. In addition, when valve means 6 is closed, an excellent sealing of the valve portion can be attained and the force necessary for the operation of the valve means can be decreased, due to the "suction" effect of the vortex flow following the "Coanda effect". Thus, there is provided a compact, and highly reliable safety device, able to be simply and inexpensively manufactured due to the facility in mounting of the two-way valve and a compact construction of the movable part thereof.

What we claim is:

1. A safety device for a cleaning apparatus for the exhaust gas in an internal combustion engine having an exhaust manifold, comprising:

a. an OR-NOR amplifier including a housing having an inlet port for the exhaust gas and first and second outlet ports for the exhaust gas, said housing providing a first vortex chamber having a first effective volume and a second vortex chamber having a second effective volume different from said first effective volume, said inlet port communicating the exhaust gas from the exhaust manifold with said first and second chambers;

b. a first passage including the cleaning apparatus for the exhaust gas, said first outlet port communicating said first vortex chamber with said first passage and the upstream end of the cleaning apparatus for the exhaust gas; and c. a second bypass passage for the exhaust gas, said second outlet port communicating said second vortex chamber with said bypass passage, said bypass passage including mechanical two-way valve means movable between two positions for opening or closing said bypass passage and for changing the flow route of the exhaust gas from said first vortex chamber and said first outlet port to said second vortex chamber and said second outlet port, said first passage downstream of the cleaning apparatus and said bypass passage downstream of said valve means meeting one another to form a part of an exhaust pipe.

2. A safety device according to claim 1 wherein said housing has a rectangular section.

3. A safety device according to claim 1 wherein said second vortex chamber has a smaller effective volume than said first vortex chamber.

* * * * *